US011267146B2

(12) United States Patent
Kruse et al.

(10) Patent No.: US 11,267,146 B2
(45) Date of Patent: Mar. 8, 2022

(54) CUTTER HEAD AND HAIR-CUTTING MACHINE THEREFOR

(71) Applicant: EXONDA SALON TOOLS GMBH, Eiterfeld (DE)

(72) Inventors: Reinhard Kruse, Gelnhausen (DE); Alfred Isaacs, Hünfeld (DE); Katharina Huck, Geisa (DE); Bernd Schmitt, Hünfeld (DE)

(73) Assignee: EXONDA SALON TOOLS GMBH, Eiterfeld (DE)

( * ) Notice: Subject to any disclaimer, the term of this patent is extended or adjusted under 35 U.S.C. 154(b) by 0 days.

(21) Appl. No.: 16/611,595

(22) PCT Filed: May 9, 2018

(86) PCT No.: PCT/EP2018/062083
§ 371 (c)(1),
(2) Date: Nov. 7, 2019

(87) PCT Pub. No.: WO2018/210670
PCT Pub. Date: Nov. 22, 2018

(65) Prior Publication Data

US 2020/0156271 A1 May 21, 2020

(30) Foreign Application Priority Data

May 15, 2017 (DE) ..... 10 2017 110 525.5

(51) Int. Cl.
*B26B 19/06* (2006.01)
*B26B 19/20* (2006.01)
*B26B 19/38* (2006.01)

(52) U.S. Cl.
CPC ..... *B26B 19/205* (2013.01); *B26B 19/06* (2013.01); *B26B 19/20* (2013.01); *B26B 19/38* (2013.01);

(Continued)

(58) Field of Classification Search
CPC ..... B26B 19/20; B26B 19/205; B26B 19/06; B26B 19/38; B26B 19/386; B26B 19/3873; B26B 19/3886

(Continued)

(56) References Cited

U.S. PATENT DOCUMENTS 2,006,493 A * 7/1935 Andis ..... B26B 19/205 30/201
2,265,880 A 12/1941 Wahl (Continued)

FOREIGN PATENT DOCUMENTS

CA 2 381 295 * 10/2002 ..... B26B 19/205
CA 2 923 901 * 9/2016 ..... B26B 19/205

(Continued)

OTHER PUBLICATIONS

International Search Report, dated Nov. 15, 2018, corresponding to International Application No. PCT/EP2018/062083.

(Continued)

*Primary Examiner* — Clark F Dexter
(74) *Attorney, Agent, or Firm* — Ladas & Parry LLP; Malcolm J. MacDonald

(57) ABSTRACT

A cutter head (10) for a hair cutting machine, having an upper blade (14) and a lower blade (12) that is adjustable relative to the upper blade using an actuating element (100), having a support (32) with an adjusting element (16) which is adjustable relative to the support using the actuating element (100) and which carries out a relative movement between the upper blade and the lower blade in the direction of cutting. The actuating element can be selectively placed in one of two opposite side areas of the support for actuating the adjusting element connected to the lower blade (12). The actuating element (100) is removably connected to a shaft (62), mounted in the support (32), having a first element. The (Continued)

Figure 1:
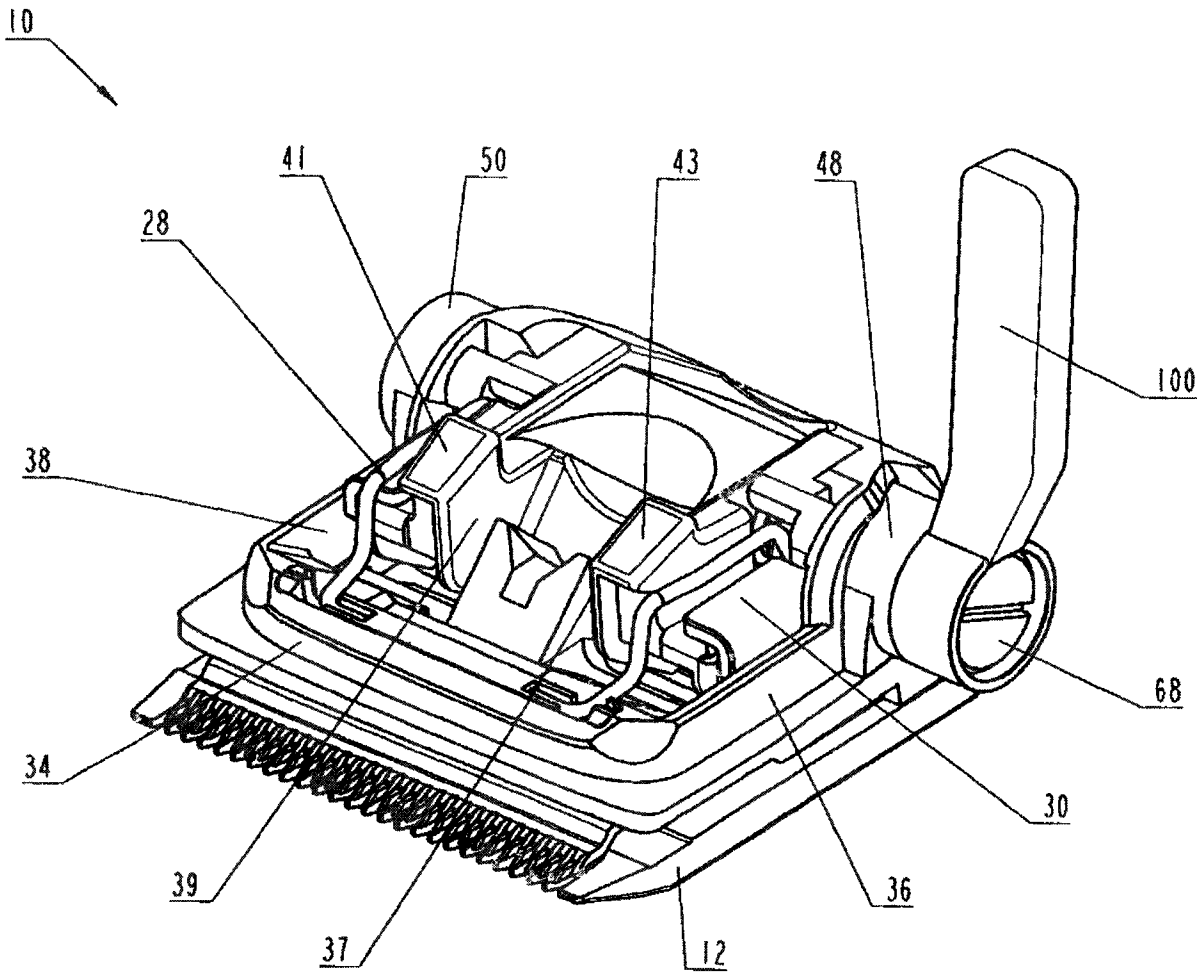

adjusting element is a second element having, in the cross-section, a U- and/or C-shape, the transverse or base limb being connected to the lower blade (12).

12 Claims, 6 Drawing Sheets

(52) U.S. Cl.
CPC ..... *B26B 19/386* (2013.01); *B26B 19/3873* (2013.01); *B26B 19/3886* (2013.01)

(58) Field of Classification Search
USPC ..... 30/200–202
See application file for complete search history.

(56) References Cited

U.S. PATENT DOCUMENTS 2,731,720 A * 1/1956 Henard ..... B26B 19/20 30/201
2,795,848 A * 6/1957 Andis ..... B26B 19/205 30/201
2,795,967 A * 6/1957 Wahl ..... B26B 19/205 74/531
2,869,234 A 1/1959 Andis
3,031,758 A * 5/1962 Wahl ..... B26B 19/205 30/201
3,093,901 A 6/1963 Wahl
3,295,201 A * 1/1967 Pucino ..... B26B 19/20 30/200
3,430,342 A * 3/1969 Wahl ..... B26B 19/205 30/201
5,084,974 A * 2/1992 Sukow et al. ..... B26B 19/20 30/201
6,742,262 B2 6/2004 Rizzuto, Jr. et al.
8,341,846 B1 1/2013 Holmes
8,478,115 B2 7/2013 Soresina et al.
9,545,729 B2 * 1/2017 Buck, Jr. et al. ..... B26B 19/205
2004/0043665 A1 3/2004 Chen
2004/0221458 A1 11/2004 Pleshek
2006/0228936 A1 10/2006 Chen
2017/0033524 A1 2/2017 McCord

FOREIGN PATENT DOCUMENTS

CH 247791 * 12/1947 ..... B26B 19/20
DE 1 090 544 * 10/1960 ..... B26B 19/205
DE 1193834 B 5/1965
GB 591709 * 8/1947 ..... B26B 19/205
WO 2009109820 A1 9/2009
WO 2010112135 A1 10/2010

OTHER PUBLICATIONS

Non-English German Office Action dated Feb. 7, 2018, corresponding to German Application No. 10 2017 110 525.5.

* cited by examiner

D-D

CUTTER HEAD AND HAIR-CUTTING MACHINE THEREFOR

The invention relates to a cutter head for a hair cutting machine, with an upper blade and a lower blade that can be adjusted relative to the upper blade by means of an actuating element, comprising a support with an adjusting element, which along the cutting direction effects a relative motion between the upper and lower blades, and which can be adjusted relative to the support via the actuating element, whereby the actuating element can be inserted selectively into one of two opposing lateral areas of the support in order to actuate the adjusting element, which is connected to the lower blade, and whereby the actuating element can be detachably connected to a shaft mounted in the support or to a first element originating from said shaft.

The invention further relates to a hair cutting machine.

DE 1 193 834 B discloses a hair cutting machine with an actuating element that can be inserted in more than one way in order to facilitate ease of use for both right-handed and left-handed persons.

U.S. Pat. No. 9,545,729 B2 discloses a cutter head with an actuating element that is used to adjust an adjusting element that is connected to the lower blade of the cutter head.

Hair cutting machines in accordance with U.S. Pat. Nos. 6,742,262 B2, 8,341,846 B1, or 3,093,901 A are constructed exclusively for right-handed use. A left-handed person trying to adjust the lower blade relative to the upper blade on principle can not perform this single-handedly. Ease-of-use suffers.

The objective of the present invention is to further develop a cutter head and a hair cutting machine of the above-mentioned type in such a way that with simple design measures will allow both right-handed as well as left-handed users to operate the device with ease.

To meet this objective, the invention fundamentally intends that the adjusting element is a second element, which possesses a U- or C-shaped cross section as well as a transverse or base arm that is connected to the lower blade, and that for adjusting the adjusting element at least one of its lateral arms interacts with the first element.

The invention provides the option that the actuating element can be inserted in two ways, thus allowing both right-handed as well as left-handed users to employ a one-handed operation to adjust the lower blade relative to the upper blade without problems. In this, it is in particular intended that the adjusting element is connected to the lower blade, i.e. that the lower blade can be adjusted relative to the housing.

The adjusting element that shifts the lower blade relative to the upper blade may be accommodated in a guide, which serves to effect a translational adjustment of the adjusting element during a rotational movement of the actuating element.

For this it is in particular intended that the actuating element can be connected to the first element that originates from the shaft mounted in the support. This shaft can be detachably connected to the actuating element. Rotating or pivoting the actuating element results in a follow movement of the shaft and consequently of the first element originating from the shaft and the first element interacts with the adjusting element in such a manner that the latter is adjusted relative to the upper blade and thus adjusts the cutting depth.

In order for the shaft or the first element originating from the shaft to be able to interact with the adjusting element, it is in particular intended that the first element, to be referred to as an entraining element, interacts with the adjusting element, and in particular engages into a cut-out provided in the adjusting element or vice versa. The latter is to mean that a projection may originate from the adjusting element that engages into a cut-out of the first element originating from the shaft.

The adjusting element is a second element that possesses a U- or C-shaped cross-sectional geometry, in particular a curved sheet-metal element, the base or transverse arm of which is connected to the lower blade. At least one of the lateral arms interacts with the at least one first element protruding from the shaft.

The term U- and C-shaped geometry is meant to indicate that one section may possess a U-shaped geometry while a different section may possess a C-shaped geometry.

In particular it is intended that two first elements protrude from the shaft and interact with the lateral arms of the adjusting element. The first elements or entraining elements preferably originate from the ends of the shaft.

It should also be emphasized that the shaft originates from the support that can be secured in position in the housing of the hair cutting machine, whereby the support preferably comprises cuboid areas with a surface, which extends in parallel to the upper surface of the lower blade and which at least in sections forms a guide for the adjusting element.

In this, it is in particular intended that inwardly angled edge areas of the lateral arms are slidable along the surface and in particular are in contact with the surface during this.

The support with the shaft may snap-fit into the housing. In this, connected to the support is the adjusting element and consequently the lower blade and the upper blade. The latter is subjected to a force bias in the direction of the lower blade by means of a spring element, which in sections may be embodied as a helical spring, and preferably comprises two arms with bent-at-right-angles end sections extending in the longitudinal direction of the adjusting element. The arms in turn are supported on a plate-like pressure element, which is movably mounted in a groove of the upper blade extending in parallel to the front side of the upper blade.

Further, connected to, i.e. inserted into, the upper blade in a known manner can be an insert, into which engages a pin-shaped section of a pinion shaft of a drive. In this, the pin-shaped section extends off-centre to the axis of the pinion shaft, which facilitates the back-and-forth motion of the upper blade relative to the lower blade.

In order to be able to pivot the shaft or the first element originating from the shaft, i.e. the entraining element, to the necessary extent, i.e. to adjust the adjusting element and consequently the lower blade relative to the upper blade to adjust the cutting depth, it is in particular intended that the support in each of its lateral sections comprises a hollow-cylindrical receptacle, that the actuating element comprises a section with an external geometry that is at least in sections matched to the receptacle and for actuation engages into the latter, and in particular that from the section originates a pin-shaped projection, which, when the section is engaged in the receptacle, extends parallel to the shaft and engages into the first element, such as the entraining element. Therefore, when the actuating element is pivoted, the first element, i.e. the entraining element, is taken along, as a result of which the adjusting element and thus the lower blade can be adjusted.

The adjusting element is connected to the shaft mounted in the support and thus in the housing, in particular via a screw element. The screw element may possess a head, and a spring element such as a helical or disk spring extends between the head and the section of the actuating element engaging into the receptacle of the support. As a result, a force is applied to the actuating element in the direction of the base wall of the receptacle, so that the section of the actuating element that at least sectionally is in contact with the base wall rests against the base wall under pressure and one consequently achieves a desired stiffness of the adjusting motion of the actuating element. This prevents an uncontrolled adjustment of the lower blade relative to the upper blade.

For the purpose of limiting the pivoting movement, it is in particular intended that from the opening in the base wall originates a cut-out that possesses lateral limits, which form limit stops for the pin-shaped projection of the actuating element, and consequently for the rotational movement of the actuating element.

In particular, the invention is also distinguished by a hair cutting machine with a cutting head that secures the housing of the hair cutting machine in place, in accordance with at least one of the above-described features of the cutting head.

With respect to inventive merit, the invention is also characterized in that the drive unit present in the housing of the hair cutting machine can be electrically connected to an external voltage source via a rotatable coupling, in order to facilitate an easy handling of the hair cutting machine without the power cord presenting an obstacle. In this, it is in particular intended that the rotatable coupling comprises a housing with an end section extending on the hair-cutting-machine side, from which protrude annular elements arranged some distance from each other, and that when the rotatable coupling is connected to the housing of the hair cutting machine, a disk-like intermediate wall of the housing extends between the two annular elements to prevent an axial movement of the rotatable coupling while still allowing a rotary movement. The intermediate wall in particular is embodied as a perforated disk element.

It is further intended that the housing of the hair cutting machine further comprises a second intermediate wall extending in parallel to the first intermediate wall, and that when the rotatable coupling is connected to the housing, the distally extending annular element extends between the first and the second intermediate wall. The distance between the first and the second intermediate wall matches the thickness of the annular element, which provides a further safeguard against an axial displacement of the rotatable coupling relative to the housing of the hair cutting machine.

Further details, advantages, and features of the invention are not only found in the claims and the characteristic features provided therein—individually and/or in combination—but also in the following description of a preferred embodiment example shown in the figures.

Figure 2:
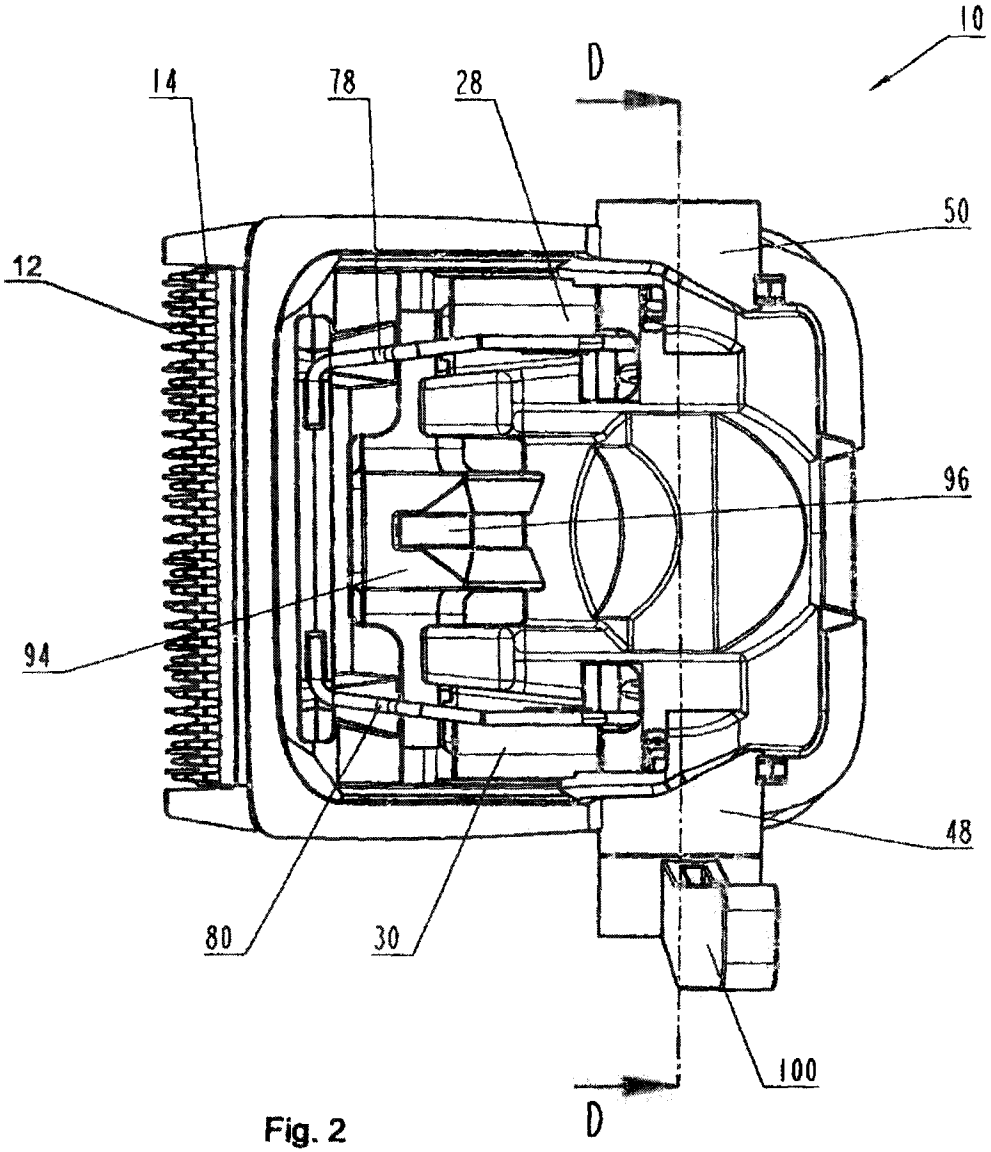
Figure 3:
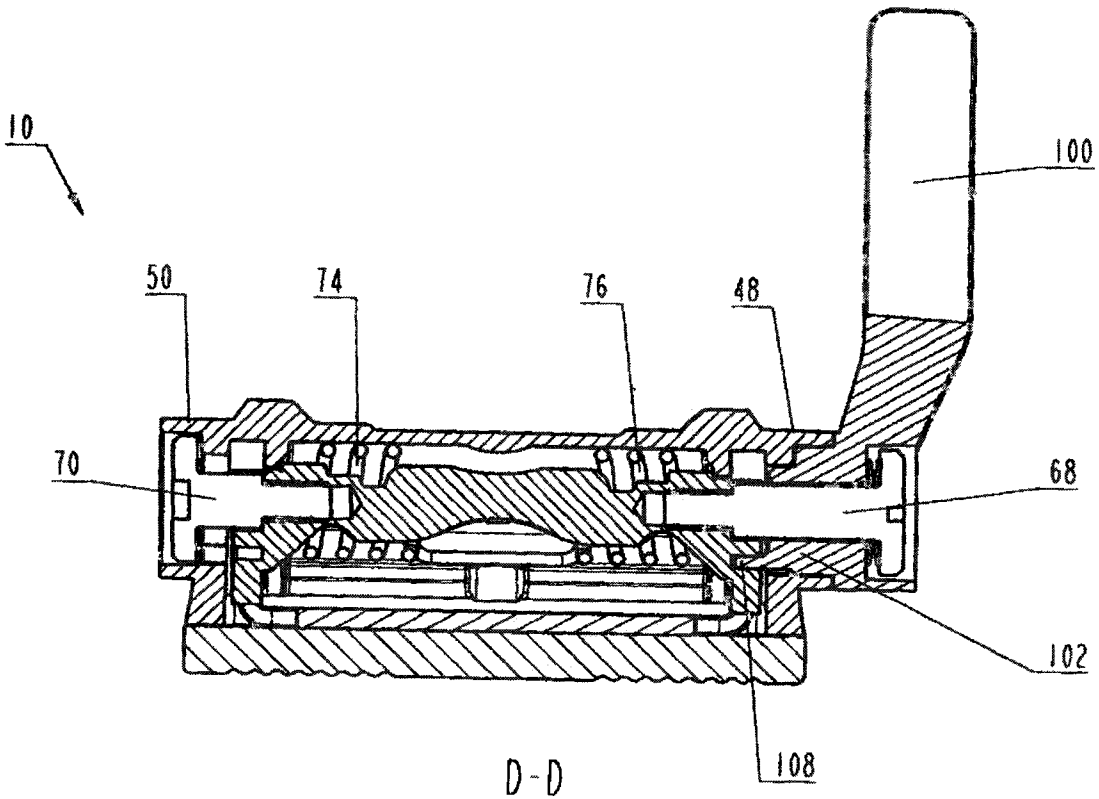
Figure 4:
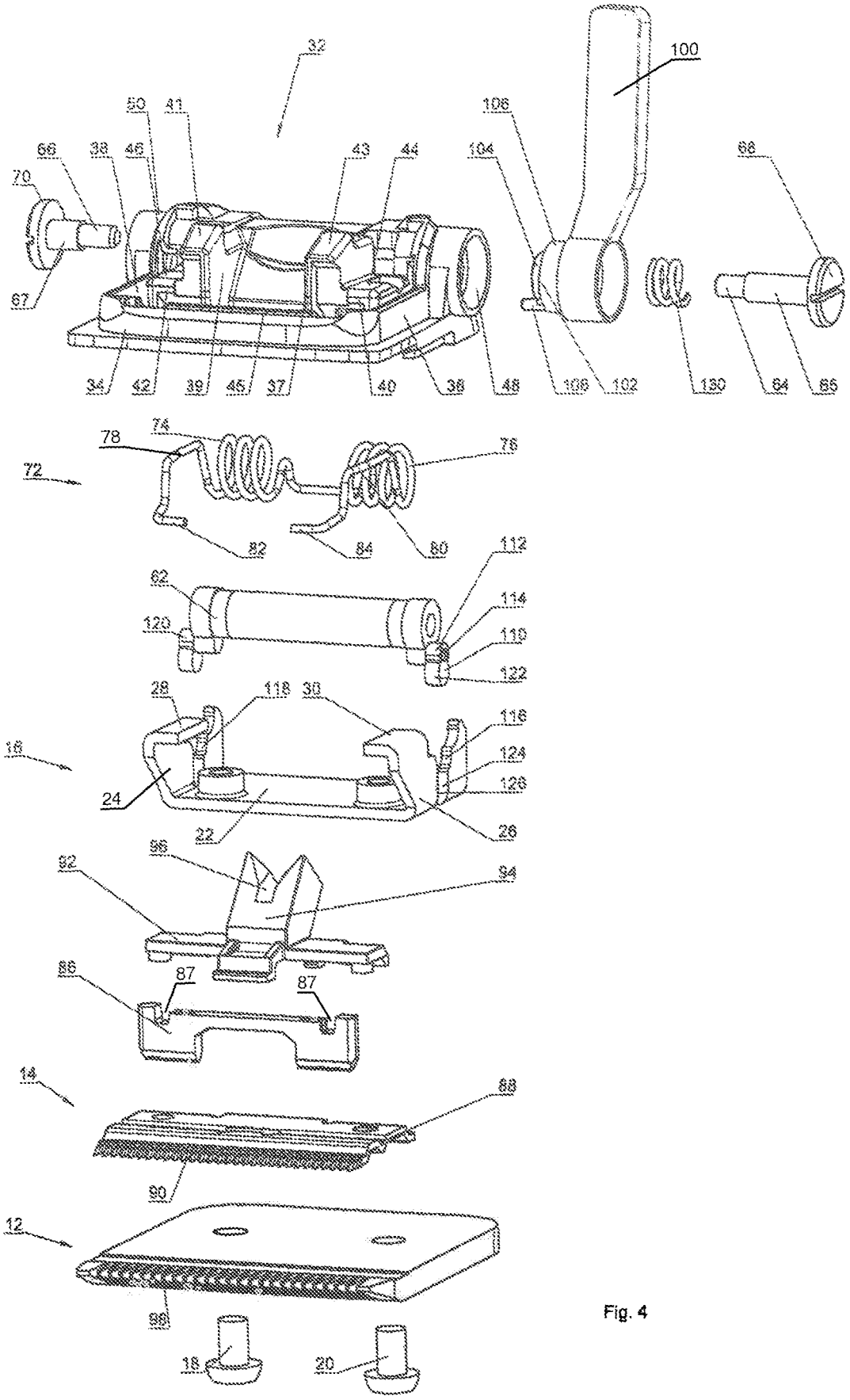

The figures show:

FIG. 1: shows a perspective representation of a cutter head;

FIG. 2: shows a top view onto a cutter head of FIG. 1;

FIG. 3: shows a sectional view along the line D-D of FIG. 2;

FIG. 4: shows a first view of an exploded representation of the cutter head of FIG.

Figure 5:
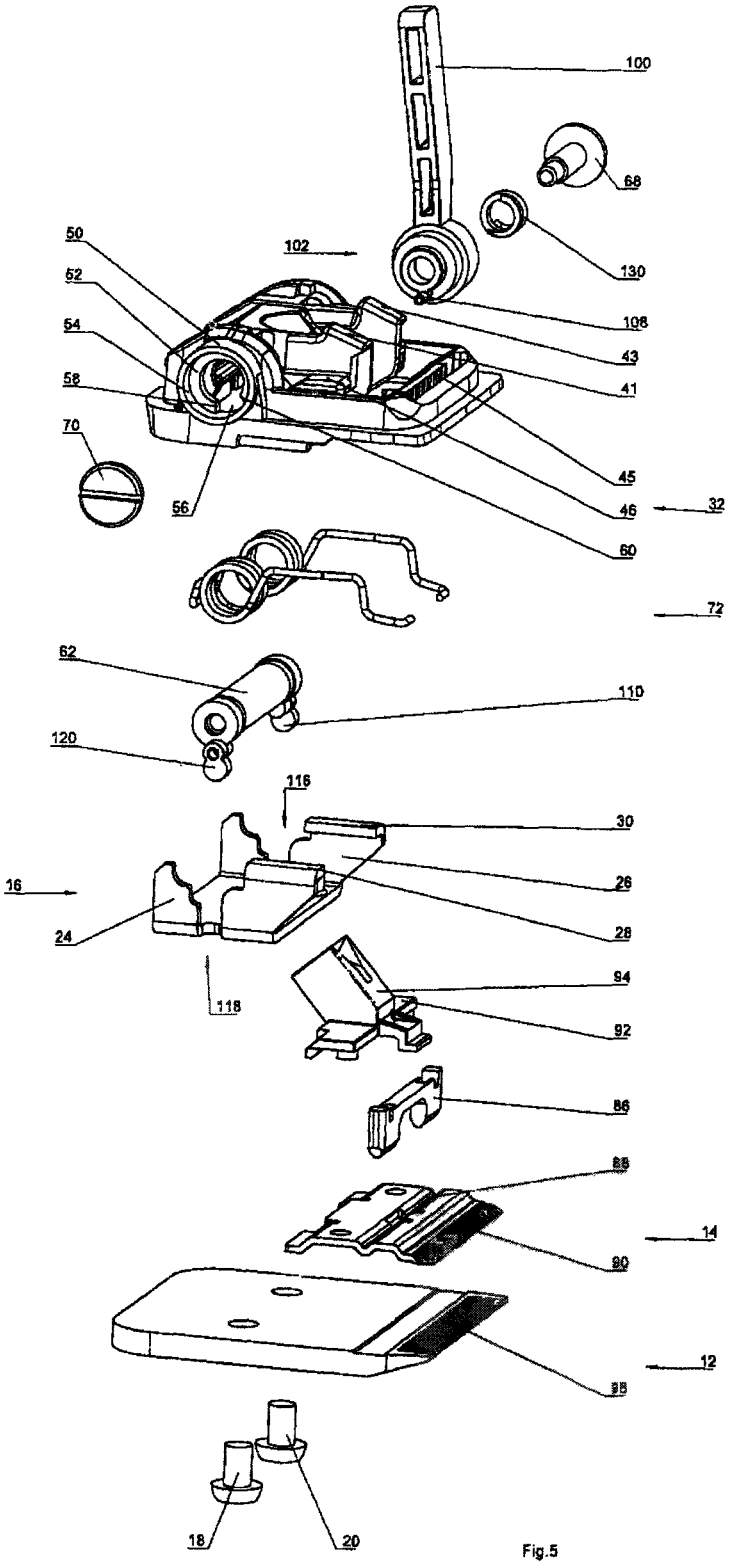
Figure 6:
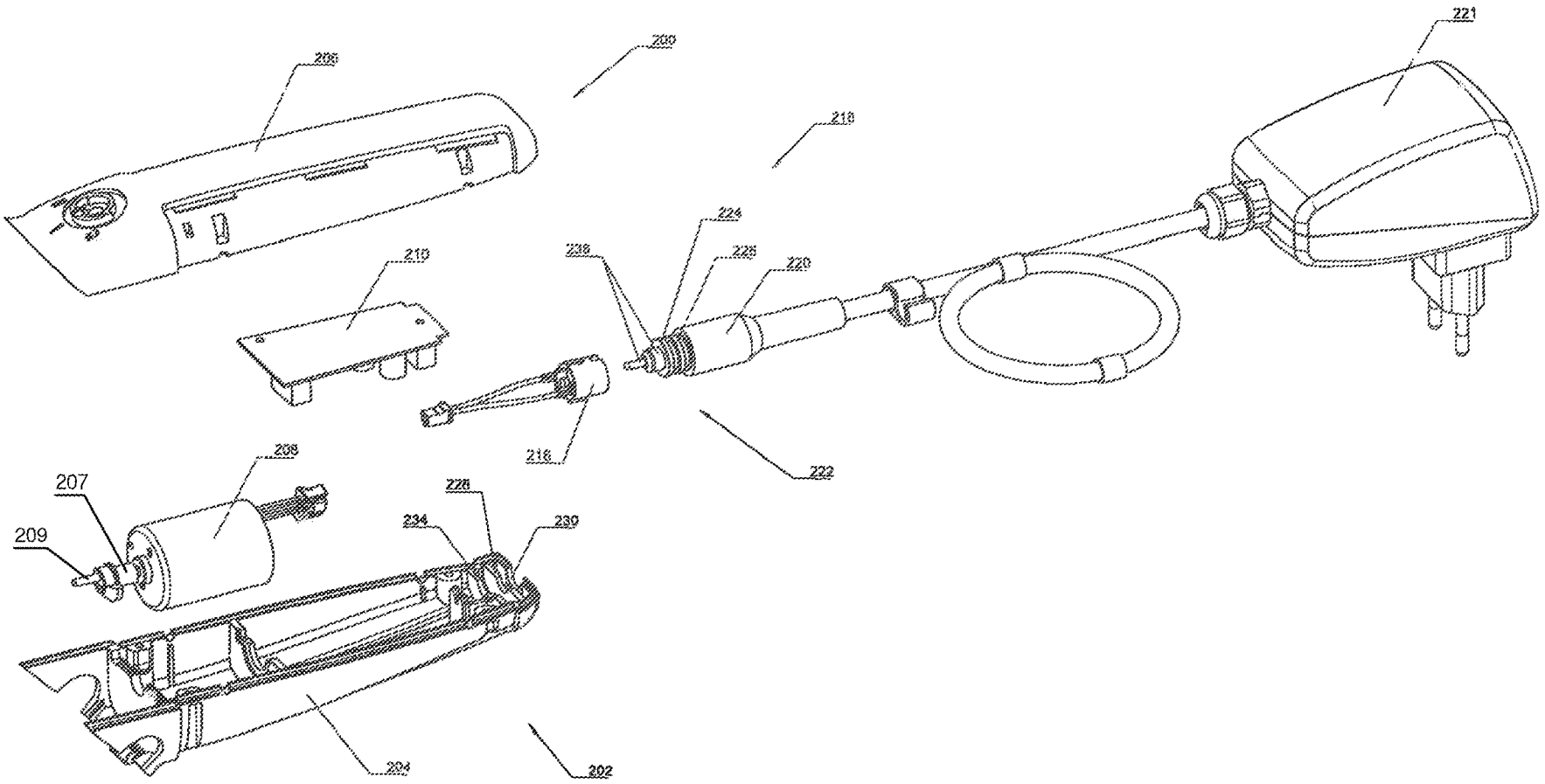

FIG. 5: shows a second view of an exploded representation of the cutter head of FIG. 1; and FIG. 6: shows in a schematic representation an exploded view of the hair cutting machine with rotatable coupling and power supply unit.

FIGS. 1 to 5, in which identical components are marked with the same reference labels, show a cutter head 10, which can be inserted into an illustrated housing 200 of a hair cutting machine 202 (see FIG. 6), where it can in particular be latched.

During operational use of the hair cutting machine 202, the cutter head 10 is secured in a fixed position in the housing.

As will be explained below, the cutter head 10 is embodied so that the hair cutting machine 202 can be used and the cutting depth can be adjusted single-handedly by both right-handed as well as left-handed users.

The cutter head 10 comprises a lower blade 12 and an upper blade 14. Connected to the lower blade 12 is a bracket 16—to be referred to as an adjusting element—which is connected to the lower blade via bolts 18, 20. The adjusting element or bracket 16 is referred to as a second element.

The bracket 16 possesses a cross section with a U-shaped geometry with a base or transverse arm 22 in a horizontal position, and lateral arms 24, 26, which exhibit inwardly wrapped edge sections 28, 30, which, in the embodiment example, do not extend over the entire width of the lateral arms 24, 26. Consequently, sections have a U-shaped geometry with inwardly extending arms of the U.

Further, the cutter head 10 comprises a support 32, which is secured in a fixed position in the housing 200 of the hair cutting machine 202. The support 32, which can also be referred to as a cutting insert carrier 32, comprises a frame 34 with lateral walls 36, 38, at some distance from which extend cuboid sections 40, 42 with upper guide surfaces 44, 46, along which extend at least in sections the inwardly angled edge sections 28, 30 of the bracket 16, possibly being in contact with the guide surfaces. Consequently, the surfaces 44, 46 are guide surfaces for the inwardly angled sections 28, 30 of the bracket 16 and consequently a guide for the bracket 16 itself.

The lateral arms 24, 26 extend in the respective gap between the lateral walls 36, 38 and the sections 40, 42.

In the rear area, i.e. distant from cutting edges 90, 98 of the upper and lower blades 14, 12, the support 32 comprises in the area of the lateral walls 36, 38 receptacle eyelets 48, 50, each of which is bordered on the inner side by a base wall 52, which in turn comprises an opening 54 with a cut-out 56, which originates in the opening, extends in the base wall, and possesses lateral limits 58, 60.

Extending between the eyelets 48, 50 is an axle or shaft 62 that is connected to threaded sections 64, 66 of bolts 68, 70 that can be inserted into the eyelets 48, 50. Rotatable support is provided by the sections 65, 67 of the bolts 68, 70.

From the shaft 62 originates a spring 72 with two helical sections 74, 76, each of which comprises a protruding arm 78, 80 with ends 82, 84 bent at right angles. The bent-at-right-angles ends 82, 84 of the arms 78, 80 are supported upon a thin-plate-like pressure element 86 with a cross-sectional U-shaped geometry, which in turn passes through a slit 45 in the support 32 and is supported on a groove 88 of the upper blade 14 that extends in parallel to the cutting edge 90 of the upper blade 14. This establishes a mounting support for the pressure element 86. In this, the bent-at-right-angles ends 82, 84 of the arms 78, 80 are supported in recesses such as grooves 87 present in the upper margin of the pressure element 86.

An entraining member 92, which interacts with a drive present in the hair cutting housing, can be inserted in the area of the upper blade situated far from the cutting edge of the upper blade 14. For this purpose, the entraining member 92 possesses an extension 94 with a slit 96, into which engages a pin 209 originating from a pinion shaft 207 of an electric motor 208. In this, the pin 209 is arranged off-centre relative to the longitudinal axis of the pinion shaft 207, so that a rotation of the pinion shaft 207 causes the upper blade 14 to perform an oscillating motion in parallel to the cutting edge 90.

In order to adjust the bracket 16, and thus the lower blade 12, perpendicularly to the cutting edge 98 of the lower blade and the cutting edge 90 of the upper blade 14, for the purpose of adjusting the cutting depth, the embodiment example includes an actuating element, 100, which is embodied as a lever and which can be inserted selectively either into the eyelet 48 or into the eyelet 50, depending on whether the hair cutting machine is to be operated by a right-handed or a left-handed user.

The lever 100 comprises a cylindrical section 102, which matches the inner geometry of the eyelet 48, 50, and which extends transversely relative to the longitudinal axis of the lever 100, and in the embodiment example consists of two sections 104, 106 of different diameter. The inside geometries of each of the eyelets 48, 50 is embodied correspondingly. Between the sections 104 and 106 extends a step, from which protrudes a pin-shaped element 108, which in the embodiment examples interacts with the first element on one end of the shaft 62, which is an entraining element 110, which is also referred to as a first driving element 110, and which protrudes from the one end the shaft 62, when the lever 100 is inserted in the eyelet 48. In the embodiment example, the entraining element 110 possesses a figure-8-shaped geometry, whereby provided in the upper section 112 is an opening 114, into which engages the pin 108 when the lever 100 is inserted into the eyelet 48.

As mentioned before, the entraining element 110 is rigidly connected to the shaft 62, which is rotatably mounted via the sections 65, 67 of the bolts 68, 70.

On the opposite end of the shaft 62, another first element is provided and is an identical entraining element 120, which is also referred to as a second driving element 120, and which originates from the opposite end of the shaft 62.

In the assembled state of the cutter head 10, the entraining element 110 engages into a cut-out 116 of the lateral arm 26 of the bracket 16. A corresponding cut-out 118 is also provided in the opposing arm 24, into which the entraining element 120 engages, which also originates from the shaft 62. The geometry of the entraining element 120 corresponds to that of the entraining element 110.

The cut-out 116 in the lateral arm 26 possesses a slit 124, which at least on one side matches the geometry of the sections 112 and 122 of the entraining element 110, 120. On the opposite side, the slit may be bordered by a wall 126 extending straight. Rotating the lever 100 causes the shaft 62 and the entraining element 110, 120 to turn as well, since as mentioned before the pin 108 engages into the recess 114 of the entraining member 110, 120 protruding from the shaft. As a result of this, the bracket 16 is subjected to a translational adjustment, since the bracket 16 is guided along the guide surfaces 44, 46 of the support 32.

To relocate the lever 100, one loosens the bolt 68, pulls the lever 100 and a spring 130 from the eyelet 48, and after removal of the bolt 70, inserts them into the opposing eyelet 50. Subsequently, the bolt 70 is secured in the eyelet 48, which simultaneously effects the mounting of the shaft 62.

For the purpose of limiting the pivoting movement of the lever 100, the cut-out 56 is provided, which originates from the opening 54 in the base wall 52 of the respective eyelet 48, 50. The boundary walls 58, 60 interact with the pin 108, and in particular that section of the pin 108 that extends along the outside of the inner cylindrical area 104 of the section 102 of the lever 100.

The support 32 also comprises inner walls 37, 39 which extend in parallel to each other and between which extends the section 94 of the entraining member 92 with the slit 96, into which the drive shaft engages.

In the embodiment example, the walls 37, 39 comprise outwardly angled lateral sections 41, 43, below which extend the arms 78, 80 of the spring.

FIG. 6 shows in an exploded view the housing 200 of the hair cutting machine 202. The housing 200 consists of a lower and an upper shell 204, 206, which in the assembled state encompass an inner space, within which are arranged among other items the electric motor 208 to drive the upper blade 14, a circuit board 210 with electronic circuitry, as well as an electrically conductive plug connector 216 to a rotatable coupling 218. The rotatable coupling 218 provides a connection to a power supply unit 221 that can be connected to a voltage source in order to provide power to the motor 208.

The rotatable coupling 218 possesses a cylindrical housing 220, from which originates a distal cylindrical section 222, from which in turn protrude two annular disks 224, 226 in the radial direction. The annular disks 224, 226 engage into the housing 200, in order to facilitate a rotary movement of the housing 200 relative to the rotatable coupling 218.

To ensure that the rotatable coupling 218 only performs a rotary movement, and not an axial displacement relative to the housing 200, in the assembled state of the housing 200 an intermediate wall 228, which is to be referred to as perforated disk, engages into the interspace between annular disks 224, 226. The perforated disk 228 consists of constituent halves, one of which originates from the shell 204 and the other originates from the shell 206. When the housing 200 is assembled and the rotatable coupling 220 has been incorporated, the proximal annular disk 226 is positioned between the rear end face 230 of the housing 200 and the adjacent side wall 228, which creates an additional mounting support for the rotatable coupling 218, to facilitate a problem-free rotatory movement of the housing 200 about its longitudinal axis, without any axial displacement.

At some distance from the intermediate wall 228 in the housing extends a further intermediate wall 234, to which the distal surface of the annular disk 224 is adjacent or adjoined.

The interaction of the annular disks 224, 226 with the intermediate wall 228 or the intermediate wall 234 on the one hand prevents an axial shift of the rotatable coupling 218, but at the same time facilitates a smooth rotational movement on account of the dimensions of the outer diameters, which are adapted to each other.

As is evident from the graphic representation, electrical contacts 236 pass through the annular element 224 and interact with the plug connection 216 in the manner of a sliding contact, to provide power to the motor 208.

The invention claimed is:

1. A cutter head for a hair clipper, the cutter head comprising:

an upper blade;

a lower blade that is adjustable relative to the upper blade;

a support comprising a frame with side walls and cuboid sections with upper guide surfaces spaced apart from the side walls;

an adjusting element connected to the lower blade;

wherein the adjusting element has a U-shaped geometry in section including a transverse leg extending along the lower blade, first and second lateral arms directed away from the lower blade, and an inwardly angled edge portion extending from each of the first and second lateral arms;

wherein the edge portions extend along the guide surfaces of the support;

wherein each of the side walls of the support comprises a receptacle eyelet;

a shaft mounted in the support;

an actuating element detachably connected to the shaft through a selected one of the receptacle eyelets;

a first driving element extending from a first end of the shaft, and a second driving element extending from a second end of the shaft;

a first recess formed in the first lateral arm, and a second recess formed in the second lateral arm of the adjusting element;

wherein the first and second driving elements engage in the first and second recesses, respectively, in such a way that rotation of the actuating element causes the shaft to simultaneously rotate which causes the adjusting element to move in translation along the guide surfaces of the support.

2. The cutter head according to claim 1, wherein the first and second lateral arms extend equally from the transverse leg.

3. The cutter head according to claim 1, wherein the first and second driving elements are entraining members.

4. The cutter head according to claim 1, wherein the receptacle eyelets include a hollow-cylindrical geometry and are separated from one another by a distance, and the shaft extends between the receptacle eyelets, wherein the actuating element has a section that is inserted into the selected one of the receptacle eyelets to provide the detachable connection to the shaft.

5. The cutter head according to claim 4, wherein the section of the actuating element is detachably connected to the shaft by a pin-shaped projection, which engages into the corresponding first or second driving element.

6. The cutter head according to claim 4, wherein each of the receptacle eyelets of the support possesses a base wall with an opening, relative to which the shaft is aligned.

7. The cutter head according to claim 6, wherein originating from the opening present in the base wall is a cut-out that possesses lateral limits, which form limit stops for a rotational movement of the actuating element.

8. The cutter head according to claim 4, wherein the shaft is mounted via a locking or fastening element inserted in the selected receptacle eyelet, whereby the actuating element is secured in position via the locking or fastening element.

9. The cutter head according to claim 1, wherein mounted in a groove (88) of the upper blade, which groove extends in parallel to the blade edge of the upper blade, is a plate-shaped pressure element upon which acts a spring element, the spring element supported by the shaft, wherein the pressure element passes through an opening embodied in the support.

10. A hair cutting machine, comprising:

a cutter head, the cutter head comprising:

an upper blade;

a lower blade that is adjustable relative to the upper blade;

a support comprising a frame with side walls and cuboid sections with upper guide surfaces spaced apart from the side walls;

an adjusting element connected to the lower blade;

wherein the adjusting element has a U-shaped geometry in section including a transverse leg extending along the lower blade, first and second lateral arms directed away from the lower blade, and an inwardly angled edge portion extending from each of the first and second lateral arms;

wherein the edge portions extend along the guide surfaces of the support;

wherein each of the side walls of the support comprises a receptacle eyelet;

a shaft mounted in the support;

an actuating element detachably connected to the shaft through a selected one of the receptacle eyelets;

a first driving element extending from a first end of the shaft, and a second driving element extending from a second end of the shaft;

a first recess formed in the first lateral arm, and a second recess formed in the second lateral arm of the adjusting element;

wherein the first and second driving elements engage in the first and second recesses, respectively, in such a way that rotation of the actuating element causes the shaft to simultaneously rotate which causes the adjusting element to move in translation along the guide surfaces of the support;

a housing, wherein the cutter head is secured in a fixed position in the housing, a drive disposed in the housing and connected to the upper blade, and a power connecting structure for connecting the drive to an external voltage source, the power connecting structure including a rotatable coupling that is rotatably connected to the housing.

11. The hair cutting machine according to claim 10, wherein the rotatable coupling comprises a cylindrical end section from which radially protrude two annular elements arranged a distance from each other, and a disk-shaped intermediate wall of the first housing extends between the two annular elements in order to prevent an axial movement of the rotatable coupling while simultaneously allowing a rotational movement of the rotatable coupling.

12. The hair cutting machine according to claim 11, wherein in the housing, in parallel to the first intermediate wall, extends a second intermediate wall, and in between these two intermediate walls extends one of the two annular elements of the rotatable coupling.

* * * * *